US012203200B2

(12) United States Patent
Detty et al.

(10) Patent No.: US 12,203,200 B2
(45) Date of Patent: Jan. 21, 2025

(54) OUTLINE VOID PATTERN

(71) Applicants: Jason Daniel Detty, Chattanooga, TN (US); Robert A. Padgett, Chattanooga, TN (US)

(72) Inventors: Jason Daniel Detty, Chattanooga, TN (US); Robert A. Padgett, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 18/389,341

(22) Filed: Nov. 14, 2023

(65) Prior Publication Data

US 2024/0158973 A1 May 16, 2024

Related U.S. Application Data

(60) Provisional application No. 63/425,108, filed on Nov. 14, 2022.

(51) Int. Cl.
*D05C 15/34* (2006.01)
*D05C 15/10* (2006.01)
*D05C 15/18* (2006.01)

(52) U.S. Cl.
CPC ..... *D05C 15/34* (2013.01); *D05C 15/10* (2013.01); *D05C 15/18* (2013.01)

(58) Field of Classification Search
CPC ..... D05B 19/18; D05B 19/10; D05B 19/12; D05C 5/02; D05C 15/26; D05C 15/32; D05C 15/34; D05C 15/36
See application file for complete search history.

(56) References Cited

U.S. PATENT DOCUMENTS

| | | | | |
|---|---|---|---|---|
| 6,439,141 | B2 * | 8/2002 | Morgante | D05C 15/18 700/138 |
| 8,096,247 | B2 * | 1/2012 | Monroe | D05C 15/04 112/475.08 |
| 8,141,505 | B2 * | 3/2012 | Hall | D05C 15/32 112/80.23 |
| 8,430,043 | B2 * | 4/2013 | Vaughan | D05B 19/08 112/475.08 |
| 8,443,743 | B2 * | 5/2013 | Christman, Jr. | D05C 15/34 112/80.23 |
| 9,016,217 | B2 * | 4/2015 | Vaughan | D05B 19/10 112/80.23 |
| 2006/0149409 | A1 * | 7/2006 | Dabrowa | D05C 15/34 700/137 |
| 2009/0260554 | A1 * | 10/2009 | Hall | D05C 11/00 112/80.4 |
| 2017/0204546 | A1 * | 7/2017 | Padgett | D05C 5/04 |

FOREIGN PATENT DOCUMENTS

| | | | | |
|---|---|---|---|---|
| DE | 69730363 T2 * | 9/2005 | | D05C 15/18 |
| EP | 2220278 B1 * | 4/2011 | | D05C 15/18 |
| GB | 2393454 A * | 3/2004 | | D05C 15/18 |
| WO | WO-2021113865 A1 * | 6/2021 | | D05C 15/10 |

* cited by examiner

*Primary Examiner* — Danny Worrell
(74) *Attorney, Agent, or Firm* — Miller & Martin PLLC

(57) ABSTRACT

A method for automatedly inserting void stitches in the manufacture of pixel mapped patterns on tufting machines having an array of independent yarn feed devices feeding yarns to reciprocating needles employs an algorithm to determine if a stitch should have a void substituted for the stitch and then implemented.

20 Claims, 13 Drawing Sheets

Left right expanded

Left right

Diamond

OUTLINE VOID PATTERN

CLAIM OF PRIORITY

The present application claims the benefit of U.S. Provisional Patent application No. 63/425,108 filed Nov. 14, 2023, which is incorporated herein by reference in its entirety.

FIELD OF THE INVENTION

The present invention relates to the manufacture of patterned textiles, and more particularly the design and manufacture of tufted patterned textiles having selected voids tufted automatedly, particularly when using tufting machines having independent control of needles, independent control of each yarn, and/or hollow needle tufting machines.

BACKGROUND OF THE INVENTION

In the manufacture of patterned textiles, and particularly in the manufacture of tufted textile products, designs are created for fabrics in a pixel-mapped format where each pixel in a graphic representation corresponds to a separate tuft or bight of yarn that is displayed on the surface of the tufted carpet. Pixel-mapped designs became prevalent as a result of the evolution of tufting machines to possess the capability of placing a particular color of yarn at virtually any location in a given pattern. In the field of broadloom tufting machines, this capability was present in the mid to late 1990s with computer controlled needle bar shifters, servo motor driven backing feeds, and servo motor driven yarn feed pattern controls. However, even decades earlier simple patterns could be tufted in a similar fashion as typified by Hammel, U.S. Pat. No. 3,103,187 using photoelectric cells to read instructions for actuation of electromagnetic clutch operated yarn feeds.

Other types of tufting machines such as hollow needle machines manufactured by C&P/Tapistron, or the iTron machines manufactured by Tuftco Corp. have the ability to place any color of yarns in any location of the backing fabric. Independent control needle ("ICN") machines typified by Cobble's ColorTec machines, also could place any color yarn at any position on backing fabric from about 1994.

Tufted textile fabrics may be manufactured from a single color of yarn threaded in all the needles of a tufting machine. However, in commercial and hospitality markets, it is much more common that patterns will have between about three to six colors of yarn, and in some cases, even more.

The production of completed tufted textiles generally involves several distinct steps. First is the selection or creation of a pattern. Second is the tufting of a fabric by placing the yarns in a backing fabric according to the pattern. Finally, there are finishing steps to remove irregularities, to lock the tufted yarns in place with the application of a secondary backing, and to trim any uneven margins as the fabric is cut to size.

The creation of tufted fabric involves feeding yarns to needles on a tufting machine and reciprocating the needles to insert the yarns through the backing fabric. By controlling operations such as the shifting of needles, shifting of backing fabric, the feeding of the backing fabric, the amounts of yarn fed to specific needles, the types of knives and gauge parts operating to seize or cut yarns carried through the backing fabric, and in the case of ICN tufting machines, the selection of needles to penetrate the backing fabric, almost any design can be created on a properly configured and threaded tufting machine.

It can be seen that the inputs necessary to create the tufted fabric include labor, yarn, backing fabric and the typically multi-million-dollar investment in a tufting machine and yarn creel. Such tufting machines, while built on a chassis not unlike those from the last century, now include sophisticated electronics and software in addition to the many precision reciprocating and electronically driven parts that operate to move the yarns and backing as required.

With the evolution of tufting machines, the possibilities for patterns have evolved from solids, textures, geometries, repeated graphics, and copies of woven textiles, to encompass nearly photographic representations of a wide range of images. Furthermore, patterns may now be over 1000 positions in both width and length, leading to designs with over a million individual pixel-mapped positions. In modern designs, carpet patterns that have organic or natural aspects, perhaps with the appearance of fallen leaves or similar designs inspired by nature or entropy, have emerged as desirable for many large spaces.

U.S. Published Patent Application 2017/0204546, incorporated herein by reference, employs optimized yarn consumption, which is useful. The applicant has also discovered with hollow needle tufting, there is a tendency for the loops, particularly when cut, to spread out. When this happens at an interface of one yarn color and another yarn color sharp lines in designs may be blurred or virtually lost at the lateral transitions or interfaces which is often undesirable for particular patterns. Some may describe this effect as a sawtooth pattern or appearance. The reason this happens is believed to relate to the physical process by which the hollow needle tufting machine puts yarn onto the primary backing. When one switches from one color to the next, there is a half stitch past the stopping point even if that stitch past the stopping point was directed to be a non-sewing zero yarn feed rate. For more intricate designs, the design may appear to be almost "out-of-focus." Because this tendency, some designers intentionally locate void elements into the pattern so that the tufting machine stops sewing between the changes. This void keeps the color change crisper on the face. While manually inserting instructions pixel by pixel is effective, it is time consuming. FIG. 1 shows this tendency when attempting to tuft solid color squares. The same effect may also be distracting in more intricate designs.

Accordingly, in an effort to relieve this blurred line problem, the applicant believes a need exists to address this issue.

SUMMARY OF THE INVENTION

It is a present object of many embodiments of the present invention to provide an improved tufting machine and/or methodology whereby for at least some patterns a user is given the choice as to whether to omit a last stitch of a particular color which results in a no-sew position (and can be seen as a no sew location on the backstitch or back side of the backing) but on the front face of the carpet there is normally not a perceptible no-sew location, but instead, shows as what appears to be a clearer condition where there is less overlap or intermixing of adjacent yarns.

Accordingly, in accordance with a present preferred embodiment of the present invention, the software of the machine evaluates in a direction of lateral movement of the backing or needle bar relative to the direction of tuft, (i.e., normally perpendicular to the direction of tuft) whereby when a particular color is being tufted for at least two consecutive loops of that color, if selected, then the algorithm can identify the last stitch of that color and then omit it so that it is not tufted and a no-sew or non-tuft is provided no yarn so that on the back there is not a tuft, but on the front there tends to be a clear delineation between one color and the adjacent color. While this certainly can happen in an automatic fashion by the software for all yarns/colors, it may also be user selected to occur for only specific colors, yarns and/or locations and it may even be user selected based on a specific color. Remember that although a specific "color" is selected in the pattern design, specific colors may be assigned to various yarns so that multiple colors have the same yarn utilized for that color. In fact, different characteristics for each "color" can be selected by the tufting program.

Voids can be automatically or automatedly substituted (and/or the proceeding stitch is the same color then the last stitch is removed for a no-sew location) with the software by only sewing a stitch if the next proceeding stitch after it is also sewing with the same yarn and/or color. This has the effect of automatedly making the last stitch of a particular end a void as the next stitch after it will be a different color and use a different yarn. After applying this effect on all stitches, the applicant noticed that there were excessive voids or no sew stitches left in the backing in more complicated patterns because every time there was a single stitch of an end it would be removed, and a blank would be sitting there. Many times, single stitch elements exist in background noise, or element that are meant to look washed out.

The solution to this is to allow the software to specify whether the feature is on or off based on the color in the pattern design that is being used to program the machine. Any colors used to draw a washed-out section that needs single stitch resolution could be drawn in a different palette color than areas voids would be useful. Remembering these are colors used in the pcx pattern to represent design elements, and not colors of the threads used to setup the machine. Multiple colors can occur in the pattern design that all use the same color of yarn. Utilizing this technique, the same design as before can be tufted but with much greater clarity and precision to define color changes at interfaces.

This decision matrix may be as simple or complicated as the user desires. Boundaries between pixels of different colors may be evaluated. Currently stitches are dropped or removed, but other effects could be performed as well. Neighborhoods around stitches may be evaluated and voids (or other effects) implemented based on an analysis of the neighborhood analyzed.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
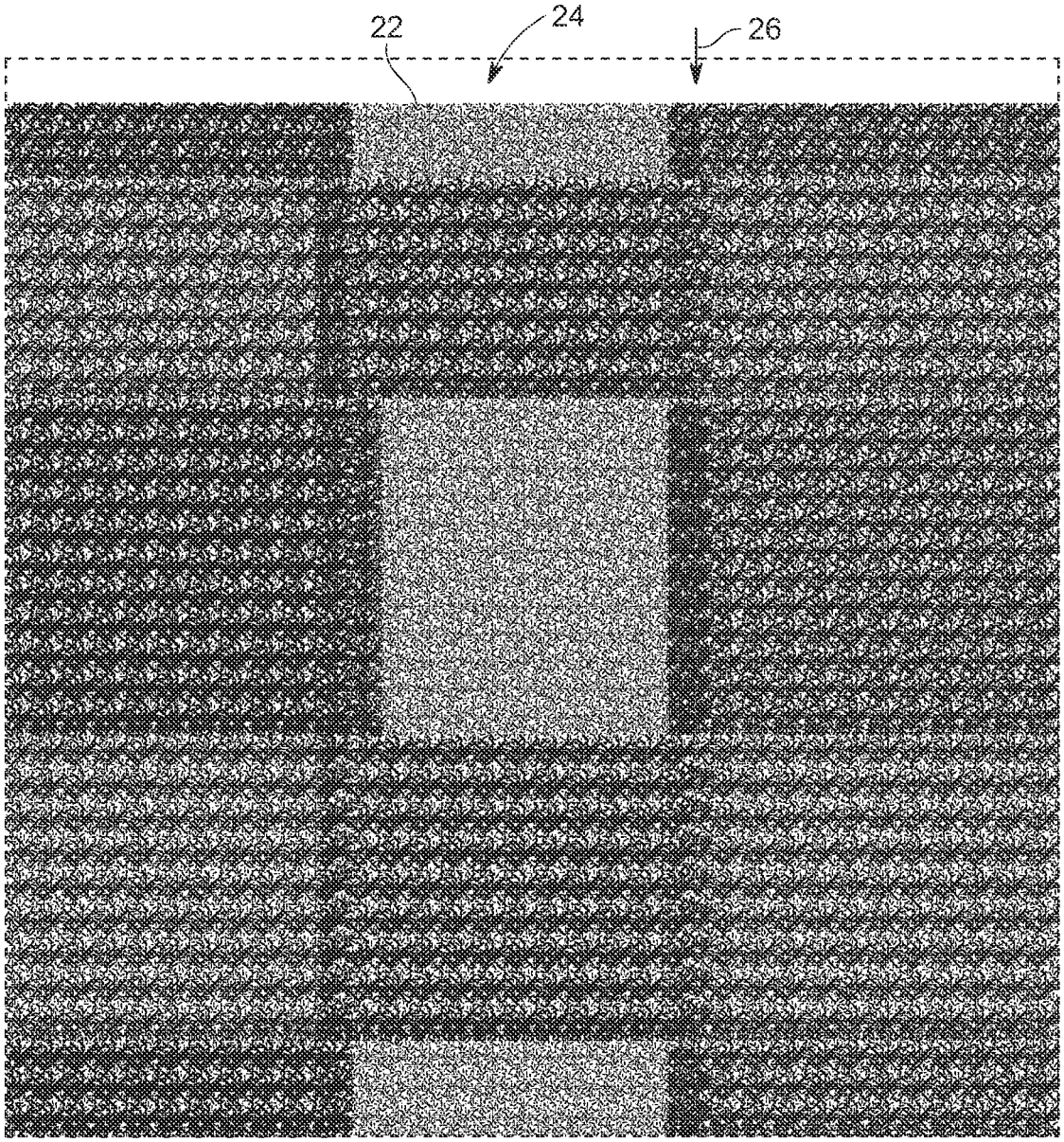
FIG. 1 (PRIOR ART)
FIG. 1 is a front plan view of a prior art sample intended to be a series of squares in the program design.
Figure 2:
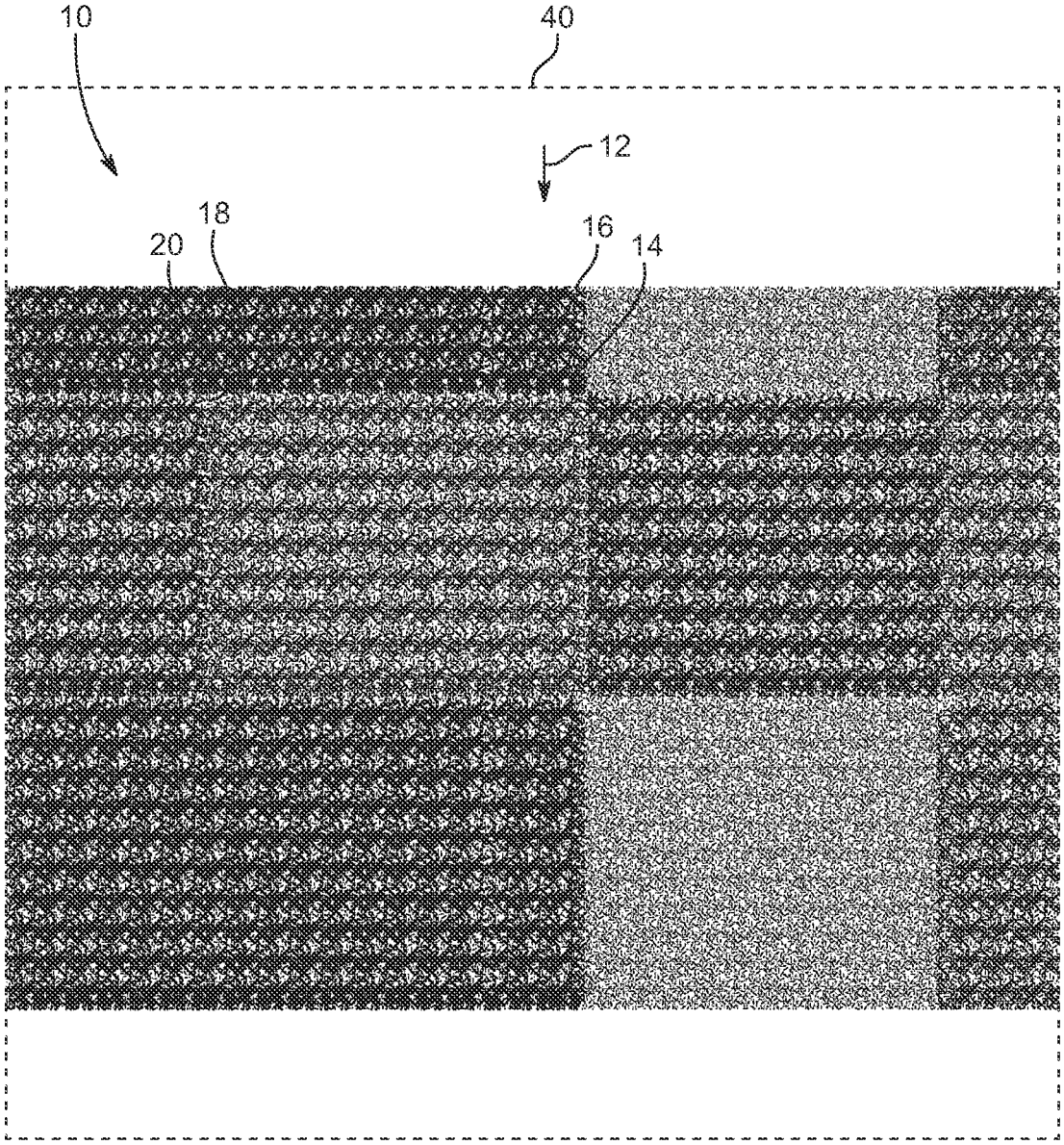
FIG. 2 is a front plan view of a tufted carpet using the applicant's equipment and methodology of the present invention.

One can quickly look at FIG. 2 and see that the tufted pattern 10 as it is tufted in a directional tuft 12 has a much more distinct interfaces 14,16,18,20 etc., than interfaces such as interface 22 of prior art design 24 which does not employ the applicant's technology as shown in FIG. 1. In FIG. 1 the direction of tufts is 26. Interfaces 22 are created when laterally shifting the backing (or needles with other machines) particularly with individually controlled yarn feed through needles. FIG. 1 shows a problem as described above which can routinely occur with hollow needle tufting as a tendency for adjacent yarns to overlap or blur interfaces 22 when one yarn color changes to another yarn color. This can routinely occur when there is no hook utilized with hollow needle tufting machines such as are shown and described in U.S. Pat. Nos. 4,549,496; 5,588,383; 4,991,523; 7,318,383 and others, all of which are incorporated herein by reference.

Since the loops are not pulled and stretched before cutting, when they are cut, the yarn ends tend to be spread out more than with hook and looper style cutting tufting machines. The design 10 of the preferred embodiment shows much cleaner interfaces 16-20 than occur with prior art machines. In order to achieve the cleaner interfaces 16-20 utilizing the exact same pattern was utilized as provided to the tufting machine except that an additional step is implemented when tufting the design 10.

Specifically, while proceeding in the direction of tuft 12 lateral shifting of the backing or needle bar relative to the direction of tuft 26 occurs to tuft a specific row such as row 30. When tufting with a particular yarn color as identified in the pattern of 10, utilizing the applicant's new technology, an algorithm is employed so that if more than one stitch of a specific color is required by a specific pattern, the last stitch on a lateral shift could be omitted to provide a no-sew instruction so that no-sew occurs such as at a void or omission 32 (either or both of at the beginning or end of multiple stitch runs). A series of omissions 32 occurs to provide line or outline 34 to more distinctly separate one yarn color from an adjacent yarn color, particularly in the lateral directions 36 of tuft which would be a direction that the needle bar or backing would shift before advancing in the direction of tuft 12 as would be understood by those of ordinary skill in the art (i.e., perpendicular to the direction of tuft). While the square pattern of design 10 may be one of the more simple designs, the more complex designs could also utilize this technology so as in such a situation the omissions 32 may not provide a line 34 parallel to the direction of tuft 12 but could instead be curves, lines or other geometric features effectively more clearly outlining specific yarn colors.

Depending on the patterns, the first stitch could also be, or alternatively be, omitted as long as two stitches of a particular color are required in order to produce the omission 32 so as to effectively outline a specific color on the reverse face 38 of the backing. This procedure often results in clearer interfaces 16-20 on the front face 40 as would appear in the design 10. By automatedly running the algorithm when selected, the user need not enter or open the pcx file with a graphics program such as APSO, NedGraphics or even MS Paint, paint.net or others, and individually remove specific stitches from the pattern.

Figure 4:
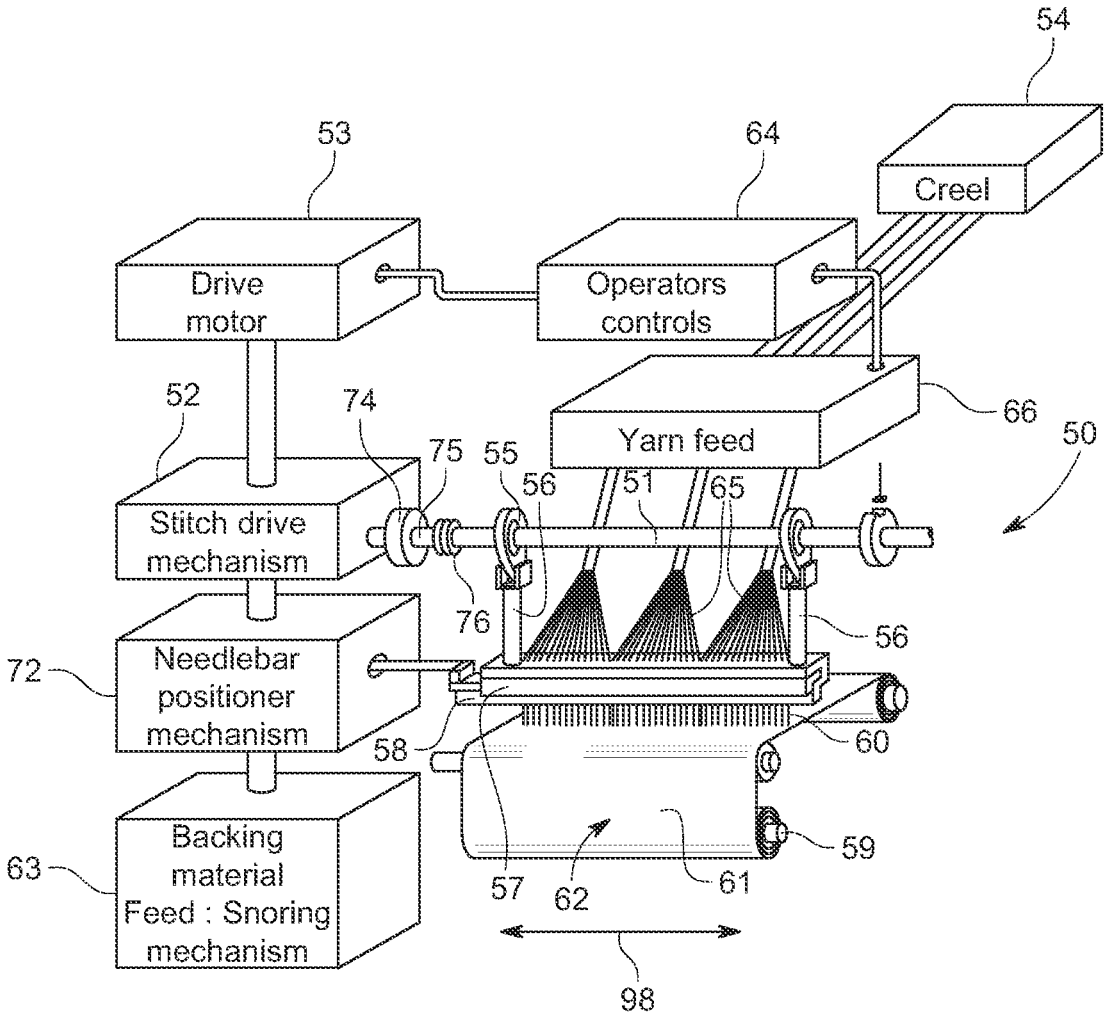
FIG. 4 shows a schematic view of a prior art tufting machine utilizing the method and technology of the present invention.

FIG. 4 shows a tufting machine (aka, a hollow needle tufting machine) utilized in the technology disclosed herein which is better shown and described in U.S. Published Patent Application No. 2020/0056314 incorporated herein by reference in its entirety. FIG. 4 illustrates a general depiction of the tufting machine 50 with take up rolls 59 for the tufted fabric and two story creel 54 to hold cones of yarn is illustrated. It should be understood that the invention can be practiced on a wide variety of tufting machines, not simply the hollow needle machine 50 depicted in FIG. 4. For instance, Tapistron™ ColorTec™ ICN machines and iTron™ hollow needle tufting machines also have the capability to place yarns in individual pixel locations according to a pattern and thus are suitably adapted to utilize with the invention. In addition, the yarn creel set up is exemplary and yarns could be supplied to the tufting machine from a single story creel or from beams that are wound for use in supplying yarns. In the typical case there will be hundreds of separate yarns fed from the creel, most frequently between about 600 and 1800 yarns and most commonly between about 1100 and 1700 yarns, although some machine and pattern combinations, such as relatively narrow hollow needle machines tufting patterns with a limited number of colors, could operate with a smaller number. A sample machine would typically have a substantially smaller tufting width and a smaller number of yarns would be fed into the pattern. The yarns will often be fed independently of other yarns using single end pattern control yarn feed devices, such as two end and/or four end feeds, etc. However, yarn optimization is also practical on tufting machines using double end or quadruple end yarn feeds, or even servo scroll yarn feed devices that carry larger pluralities of yarns that are typically distributed across the width of the tufting machine by a tube bank, or other yarn feed arrangements with an array of independent yarn feed drives. There will preferably be more than 72 independent yarn feed drives in the array and most commonly more than 300 independent yarn feed drives.

The tufting machine 50 disclosed in FIG. 4 includes a rotary needle shaft or main drive shaft 51 driven by stitch drive mechanism 52 from a drive motor or other conventional means.

Tufting machines 50 explicitly include hollow needle tufting machines as discussed herein. Rotary eccentric mechanism 55 mounted upon rotary needle shaft 51 is adapted to reciprocally move the vertical push rod 56 for vertically and reciprocally moving the needle bar slide holder 57 and needle bar 58. The needle bar 58 supports a plurality of uniformly spaced tufting needles 60 in a longitudinal row, or staggered longitudinal rows, extending transversally (laterally) of the feeding direction of the backing fabric or material 62. The backing fabric 62 is moved longitudinally in direction 61 through the tufting machine 10 by the backing fabric feed mechanism 63 and across a backing fabric support with needle plate and needle plate fingers and laterally shifted with the backing fabric feed mechanism 63 for at least some embodiments.

For hollow needle tufting machines 50, multiple yarns 65 are fed from the creel 54 to the pattern control yarn feed 66 to respective needles 20. As each needle 60 carries a yarn 65 (of the multiple possibilities) through the backing fabric 62, loops are formed. For other tufting machines, a hook often driven by a looper drive holds yarn ends to form loops. Cut pile tufts are formed by cutting loops with knives.

The backing fabric 62 is shifted relative to the needles 60 (or vice versa) a predetermined transverse distance equal to the needle gauge or multiple of the needle gauge, and in either transverse direction from its normal central position, and for each stroke of the needles 60. The backing shifter 63 may move the backing fabric 62 laterally with respect to a stationary needle bar 58. Of course, the needle bar positioning system 72 could laterally shift the needle bar 58 relative to the backing fabric 62 for other embodiments.

In order to generate input encoder signals for the backing shifting apparatus 63 corresponding to each stroke of the needles 60, an encoder 74 may be mounted upon a stub shaft 75, or in another suitable location, and communicate positional information from which a tufting machine controller can determine the position of the needles in the tufting cycle. Alternatively, drive motors may use commutators to indicate the motor positions from which the positions of the associated driven components may be extrapolated by the controller. Operator controls 64 also interface with the tufting machine controllers to provide necessary pattern information to the storage associated with the various tufting machine controllers before machine operation.

On a broadloom tufting machine, these components can be operated in a fashion to provide pixel-addressed yarn placement as described in various prior patents such as U.S. Pat. Nos. 6,439,141; 7,426,895; and 8,359,989 and continuations thereof (all of which are incorporated herein by reference). Pixel controlled yarn placement in connection with ICN machines is described in U.S. Pat. Nos. 5,382,723 and 5,143,003; (both of which are incorporated herein by reference) while pixel controlled placement of yarns utilizing hollow needle tufting machines is described in U.S. Pat. Nos. 4,549,496 and 5,738,030 (both of which are incorporated herein by reference). Software to facilitate such pixel mapped designs has been available from NedGraphics since at least about 2004 in the form of its Texcelle and Tuft programs from Tuftco Corp, in the form of its Tuftco Design System, and from Yamaguchi in the form of its design system for similar lengths of time.

Turning then to the existing process of designing and manufacturing tufted fabric as reflect in FIG. 4, the first step 88 is the creation of a graphic design to be tufted. The design can be created by an artist or adapted from a photograph or preexisting image. In either case, the image should be created or processed to limit the color palette to a manageable number of yarn colors, preferably between two and sixteen, and most commonly three to six colors. Preferably, this design process is executed on a design workstation running Texcelle or Tuftco Design software although sometimes automated design features can be included in the Operator Interface of a tufting machine.

The next step 90 is to load the image into a tufting machine having a controller running an operator interface software such as the TuftCom™ system sold by Tuftco Corp. and to process the pattern graphics to create machine instructions. The tufting machine should be threaded with appropriate yarns 91. When using the TuftCom™ system, there are two principal steps prior to creating machine instructions. One step 93 (in FIG. 5) is to assign a shift pattern or step pattern to the backing shifter 97 (shown in in FIG. 2) and a stitch rate to the pattern. Variations of the shift profile for other numbers of colors utilized on a broadloom tufting machine are well known and easily computed. It can also be seen that the stitch rate 45 may be specified which can affect the density of yarn bights and the weight of the resulting tufted fabrics.

Figure 5:
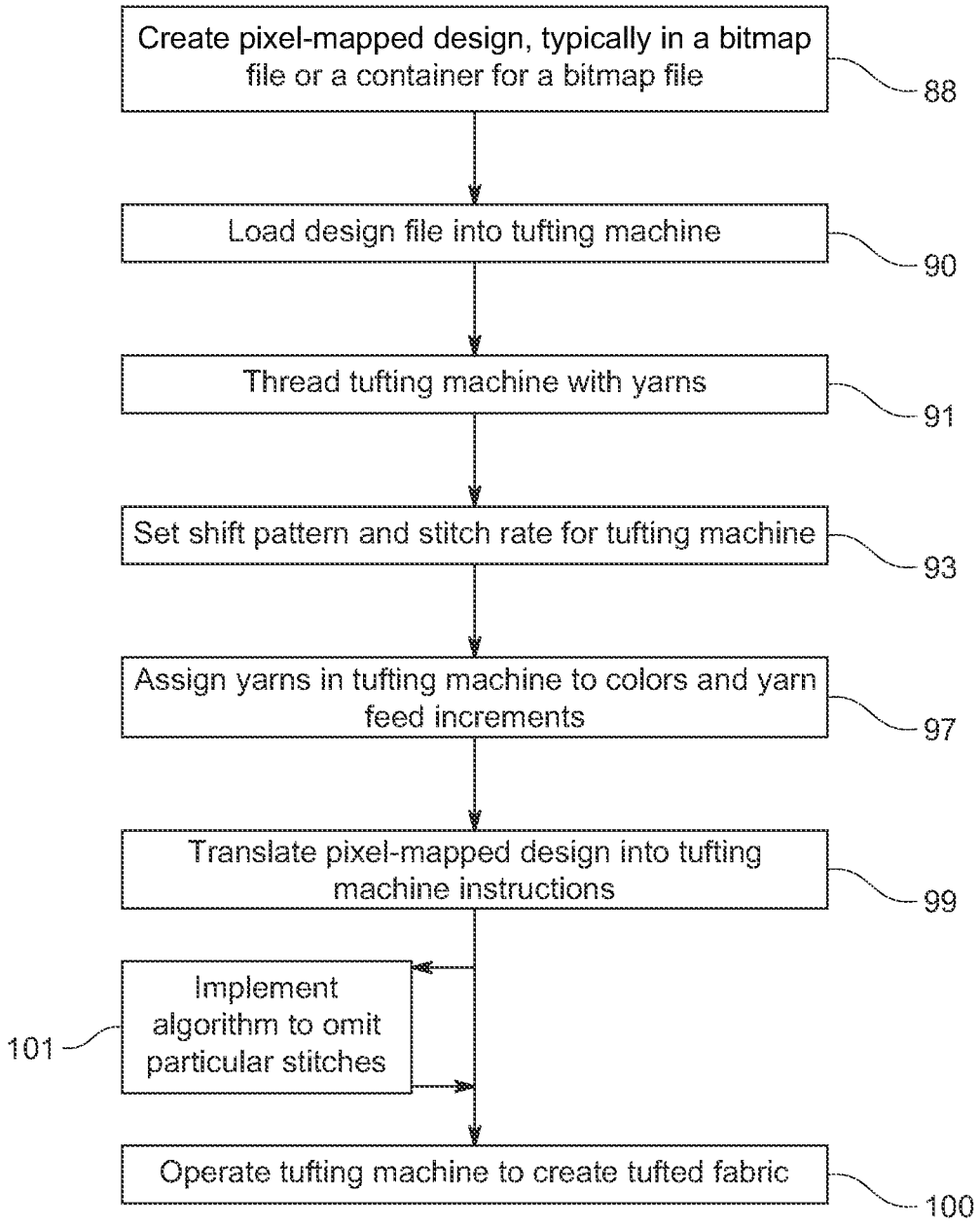
FIG. 5 shows a flowchart of the preferred embodiment of the present invention.
Figure 6:
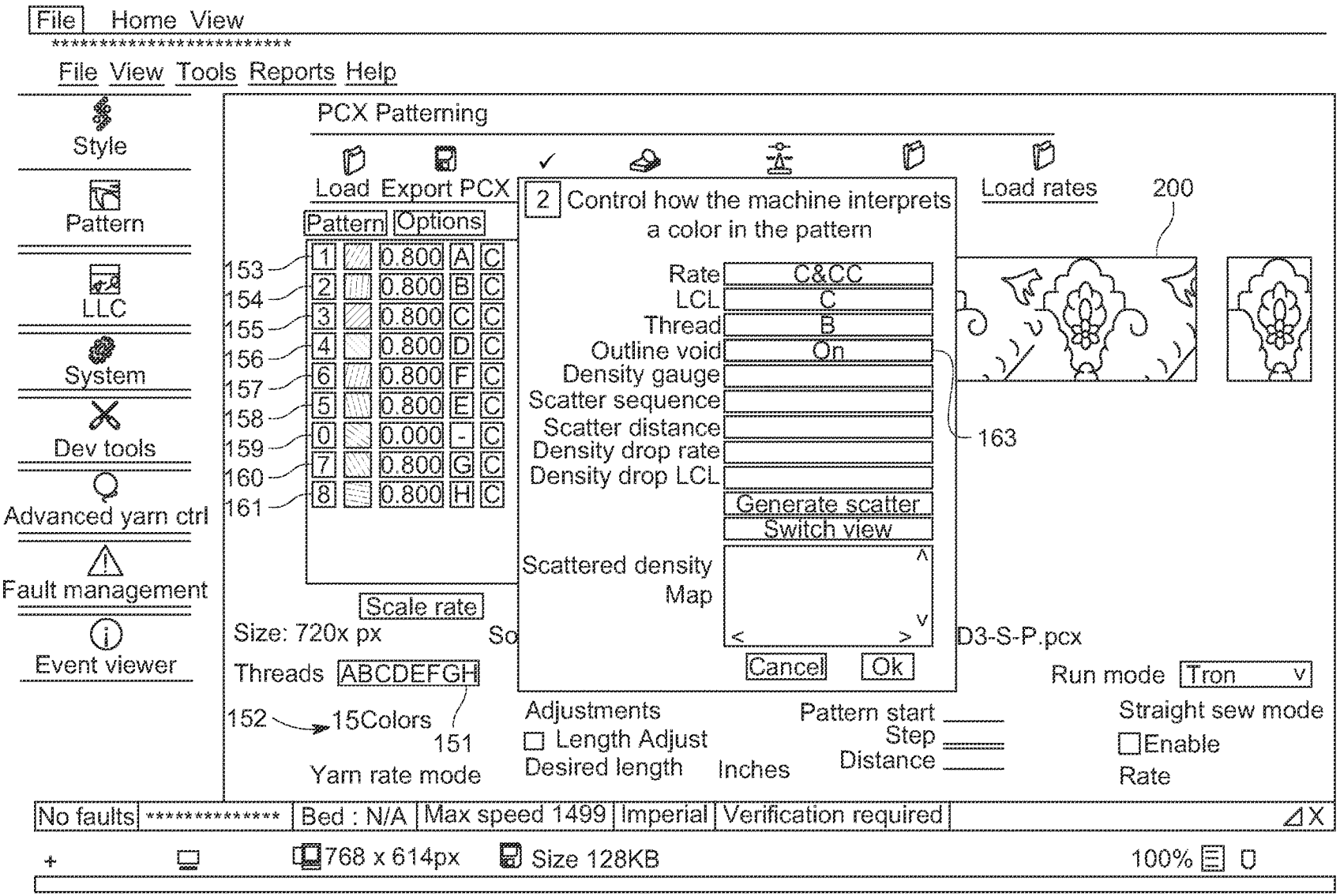
FIG. 6 is an exemplary control screen display for input of design and tufting parameters to implement the selected omission of stitches otherwise present, of a first embodiment.

In addition to entering the stepping pattern in FIG. 5, in the iTuft system the yarns and yarn feed increments are assigned to the colors in the graphic pattern (in FIG. 6) see pattern 200 using the operator controls in FIG. 6. In this example, the threadup 151 is A, B, C, D, E, F and H yarns, or seven colors 52, and the darkest blue yarns "A" are assigned 153, a slightly lighter blue 154, a lightest blue 155, a black 156, a light brown 157, a dark brown 158, a no-sew (or always sew, but with no yarn feed) 159, another light brown 160 and a grey 161. Eight colors, fewer or more, could be used with other designs of pattern 200. Tufting heights 55,56 may also be used for each color set. In the prior art, at this point the pixel-mapped design can be translated into tufting machine instructions at step 99.

Tufting machines instructions in the form of a yarn feed pattern array for the yarn feed drives, a shift pattern array for each shifter moving the needle bars or backing fabric, a backing feed instruction (or array in the event of varied stitch rates), and a cut/loop array or arrangement if operating an LCL type apparatus are transferred from the computer running the iTuft operator interface system to storage accessible by the controllers for the yarn feed, shifter, backing feed, and LCL apparatus and the tufting machine 50 as tufting machine instructions at step 99 operated to produce a tufted fabric of the design 10 at step 100. Step 101 applies the algorithm discussed herein to selectively omit certain stitches to provide cleaner interface for at least selected colors and/or other situation. Outline void option 163 may be selected using the operator controls for specific colors in the pattern 200 or by other technique to select specific colors, or areas etc., to apply automated outline voids as described herein.

In this embodiment seven color are used. Yarn F is used for both colors 157 and 160, but other characteristics could be different, such as one having an outline (outline void, the other possibly not), or having a cut loop, and/or other features. The same is true for any of the other colors (which may, or may not, use the same yarn(s)).

Figure 3:
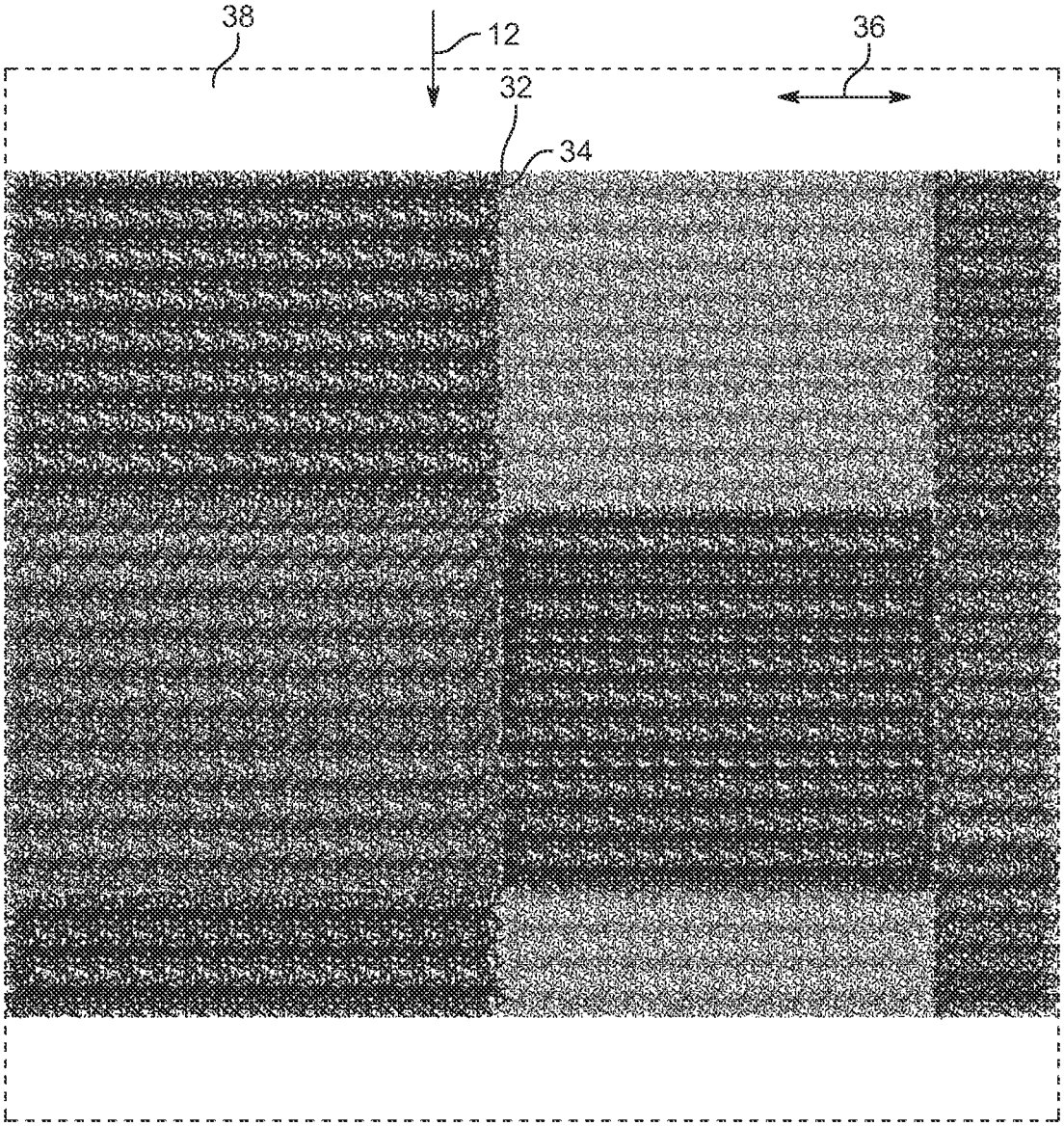
FIG. 3 is a rear plan view showing the back stitches or opposite face of the tufted pattern of FIG. 2.

Using the yarn outline void techniques of the invention requires some modifications to the prior art process. The pixel-mapped design is created as before at step 88 but then the design file is loaded into a tufting machine, or more typically a desk top simulator, at step 90. Then the shift pattern and stitch rate are set at step 93 and yarn feed increments assigned to colors in the design at step 97. After the pattern has been associated with yarns, it is then possible to automatically and/or automatedly insert no-sew locations 32 as shown in FIG. 3 based on the "color" or other characteristic of the pattern 200 at step 101. This logic involves analyzing if a "color" appears in a lateral row more than once and then providing a "no-sew" instead of a stitch of that color at the beginning and/or end of the series of stitches of that color in the row (or relocate to adjacent loops).

In the case where a single yarn drive feeds multiple yarns or in a hollow needle type machine where several yarns are selectively fed through a single needle, the logic may be performed for the yarn fed by a single yarn feed drive. This automated outline feature may be applied to specific regions of a pattern, to specific colors in the pattern, or based on some other characteristics within the pattern 10.

Remember also that although specific colors can be outlined, it may be that various colors such as 157,160 utilize the same yarns (i.e., same yarn colors) provided from the creel 14. Being the omission on a "color" facilitates the ease in designing and having an outline appear at specific locations within the design 10, but possibly not at other locations such as individual yarns provided in the pattern depending on how the color is characterized throughout the design 10. A more sophisticated algorithm and methodology is shown in FIG. 7-14 using Neighborhoods.

Outline voids are one way to drop or remove stitches automatedly along the borders of existing patterning elements based upon the colors used in the image that represents the pattern. It involves detecting the boundaries between pixels of different colors. Currently it is used to drop or remove stitches but it could be used for anything else effecting the machine's behavior such as reducing the yarn rates on these border stitches, or engaging the LCL modules to cut all the loops around the edges, or anything else we decide we'd like to do automatically along the borders of elements.

Figure 7:
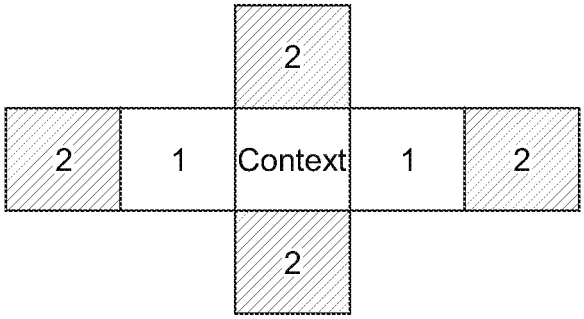
FIG. 7 is a block diagram of a first neighborhood; as a left right expanded neighborhood.
Figure 8:
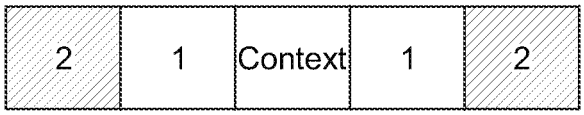
FIG. 8 is a block diagram of a second neighborhood; as a left right neighborhood.
Figure 9:
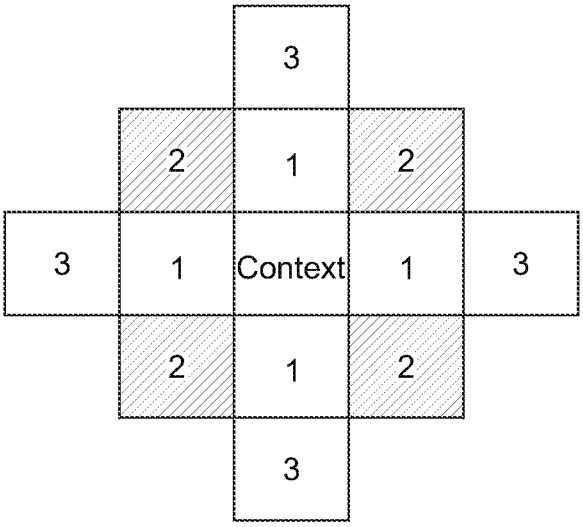
FIG. 9 is a block diagram of a third neighborhood; as a diamond neighborhood.
Figure 10:
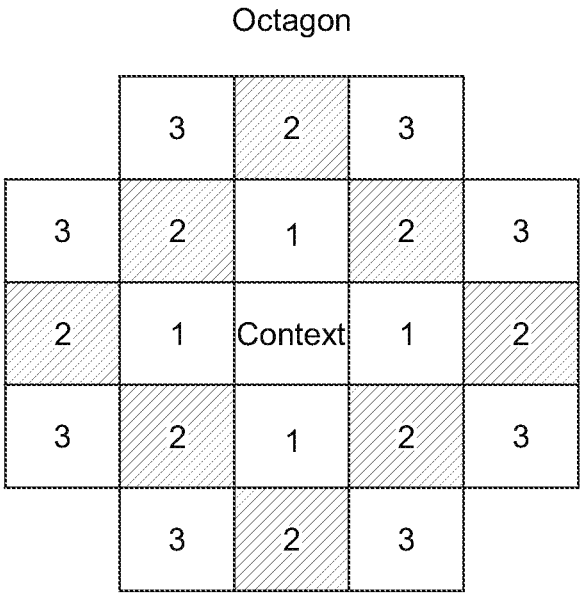
FIG. 10 is a block diagram of a fourth neighborhood; as an Octagon neighborhood.

It works primarily by knowing the behavior of each neighboring stitch at the time it is calculating what to do on the current stitch. In this way we can detect if any of the surrounding stitches are being directed by a different color in the pattern. This neighborhood is constructed by calculating the stitches for each of the cells from the center using a Von Neumann neighborhood (See Wikipedia article on Von_Neumann_neighborhood). Cells and stitches may be understood to represent the same thing. The stitches it uses can be controlled by the neighborhood attached to the current stitches color, but currently all stitches use the same neighborhood which is specified in the configuration of the software. FIGS. 7-10 show four defined neighborhoods of preferred embodiments. The Left Right Extended of FIG. 7 is a most popular method currently. Still other neighborhoods may be evaluated with other embodiments. In FIG. 7 you will see each cell around the context marked with a number. These numbers correspond to the thickness choice in the user-interface. If the user selects thin, then only the squares with a 1 in them are considered. If the user selects thick, then both the 1 and 2 squares are considered.

Figure 11:
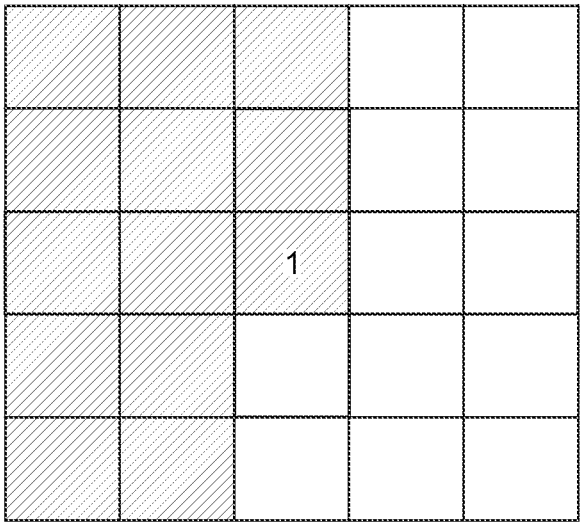
FIG. 11 shows cells of any of the embodiments of FIGS. 7-10.
Figure 12:
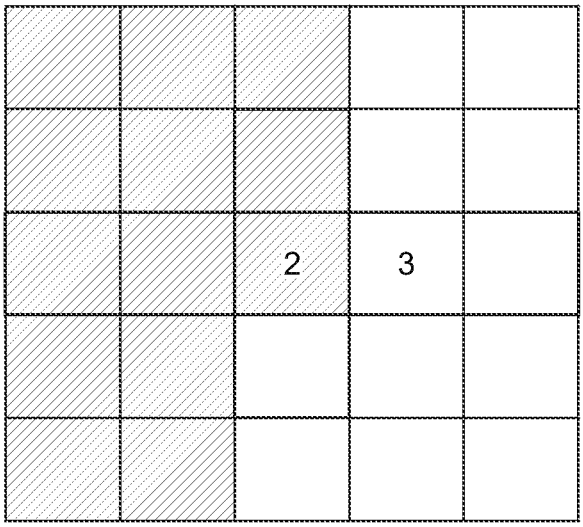
FIG. 12 shows cells of any of the embodiments of FIGS. 7-10.
Figure 13:
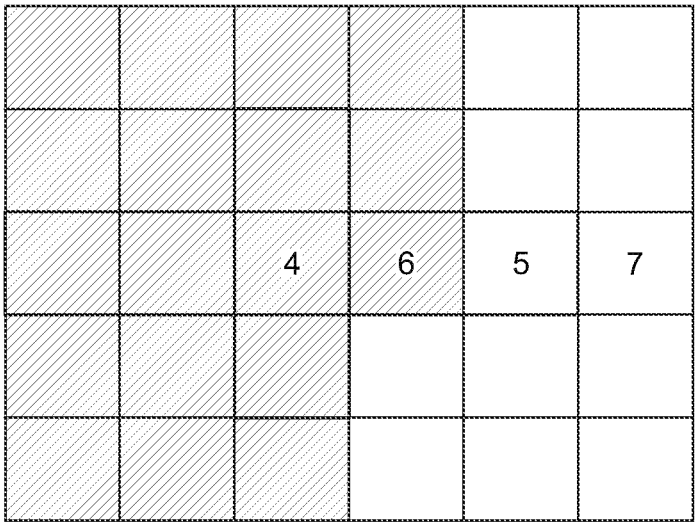
FIG. 13 shows cells of any of the embodiments of FIGS. 7-10.

A behavior switch in the user interface must refer to Inside or Outside behaviors. This is so a user can control whether the stitch being dropped will be from the context color, or the color that it is bordering. In FIGS. 11-13 you will see effects of these embodiments. If the blue or dark color has been specified to use outline voids with the left-right-extended neighborhood, the inside behavior, and thin thickness then when on stitch [1] it will decide to drop the stitch as shown in in FIG. 11. It will do this because it will consider stitch [1] as the context and apply the left-right-extended neighborhood over it first which are shown with thick borders. It will find that directly to the right of stitch [1] it is sewing a different color. That position is marked as a 1 (Thin) on the neighborhood so it will be dropped if stitch [1] is using thin or thick as the thickness. Because stitch [1] was marked inside, stitch [1] will be dropped.

FIG. 12 shows the same thing with stitch [2]. Only this time the blue or dark color has been marked to do outside behavior instead of inside. When it detects that stitch [3] is a different color it will then drop stitch [3] instead of stitch [2]. This can be understood to be outside the border of the blue area instead of inside it. Which is why the terms inside and outside were selected.

FIG. 13 explains the thick setting. Consider the same situation but with the context stitch being [4]. Because now it is marked as thick the stitch [5] will be considered in addition to the thin stitches in the neighborhood. Remember on the neighborhood chart positions with a 1 are Thin, and 2 are Thick. If the blue or dark color was marked inside, then stitch [4] and stitch [6] will be removed because they are inside the blue area. If the blue or dark color was marked outside, then stitch [5] and [7] would be removed instead. Blue or dark is selected for purposes of these examples. Any color could be utilized as discussed herein.

Figure 14:
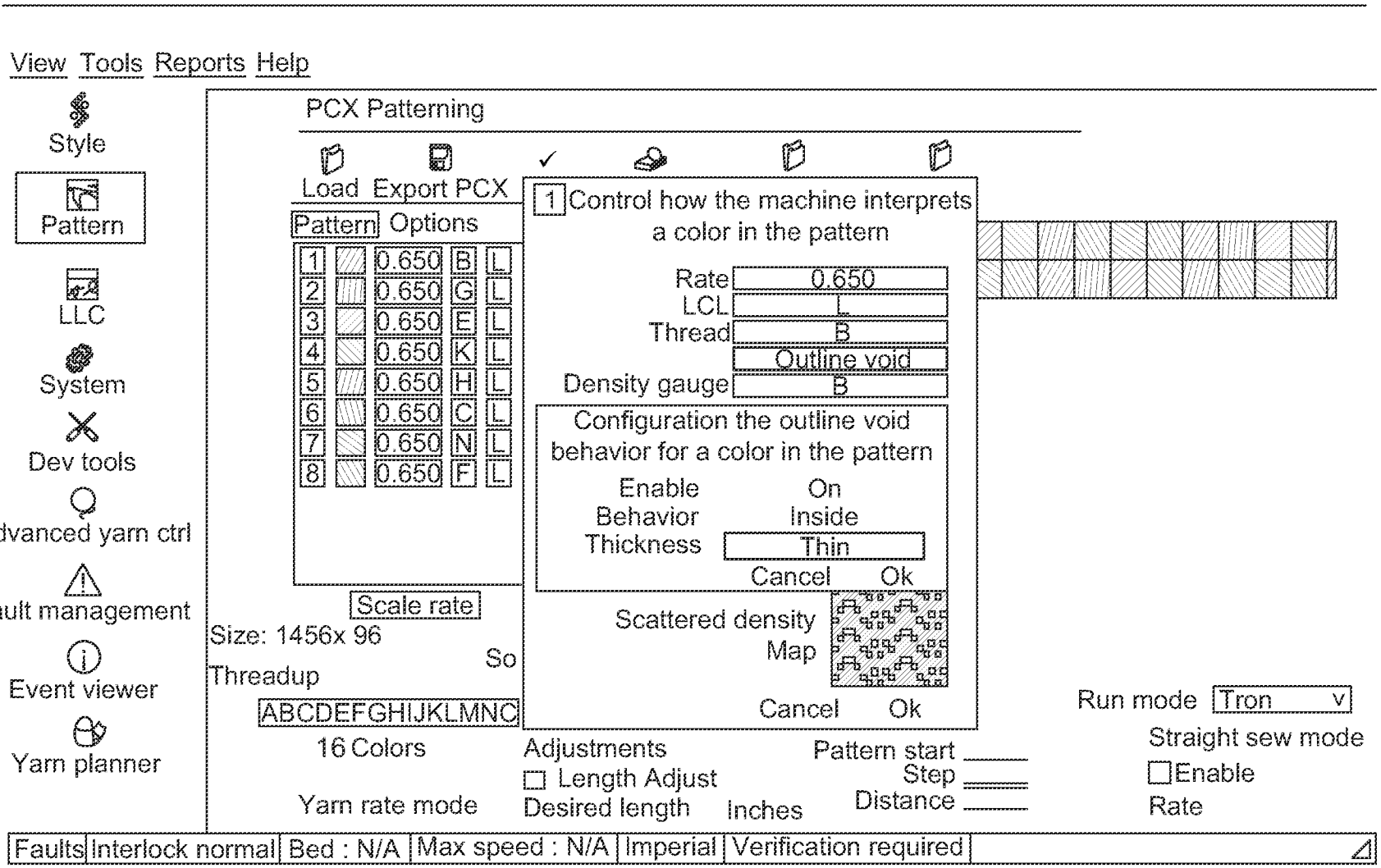
FIG. 14 is an exemplary control screen display for input of design and tufting parameters to implement the selected omission of stitches otherwise present, of a second embodiment.
Figure 15:
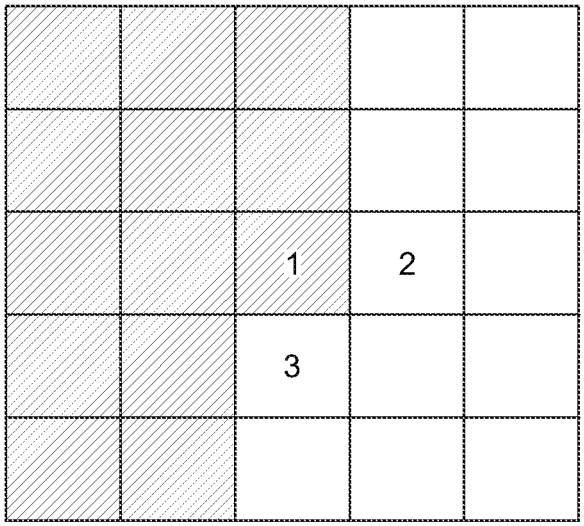
FIG. 15 shows an embodiment similar to FIGS. 11-13 applied in an alternative manner.

Currently the interface is simplified to allow a user to specify thin or thick as shown in FIG. 14, but this could be changed to anything that maps back to the numbers as used in the neighborhood. We could make an Extra-Thick that uses the 3 positions of the diamond or octagon neighborhoods. Eventually there may be a different neighborhood defined for each individual color instead of one that is presently used for everything.

The thick/thin interfaces have also evolved to include both think and thin considerations. FIGS. 15-20 show various situations of this embodiment.

Consider the stitch marked 1 as the current contest. If the blue color is marked to use outline void, then, and has been marked as using both behaviors then all stitches 1, 2 and 3 will be removed. 1 because it is inside the blue area but adjacent to a green stitch. When the contest is stitch 2 then it will also be removed because it borders on a blue pixel which is using both inside and outside behaviors. Stitch 3 will not be removed because we have indicated that we want thin and only thick would remove stitches in the vertical direction. Below is the same diagram but showing the finished product after each stitch has been considered the context. The stitches with X marked in them have been removed to create the void.

Figure 16:
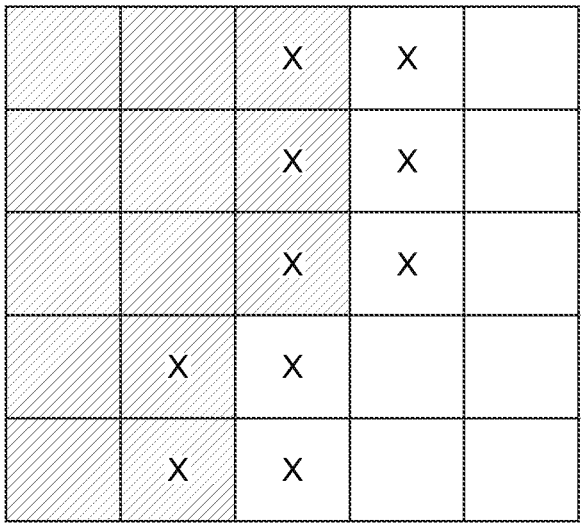
FIG. 16 shows an embodiment similar to FIGS. 11-13 applied in an alternative manner.
Figure 17:
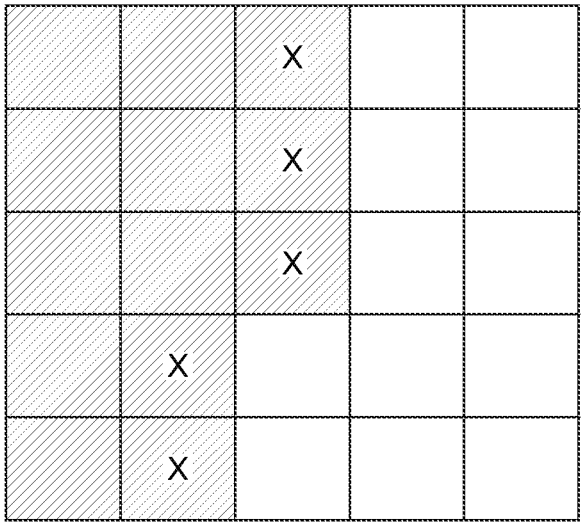
FIG. 17 shows an embodiment similar to FIGS. 11-13 applied in an alternative manner.
Figure 18:
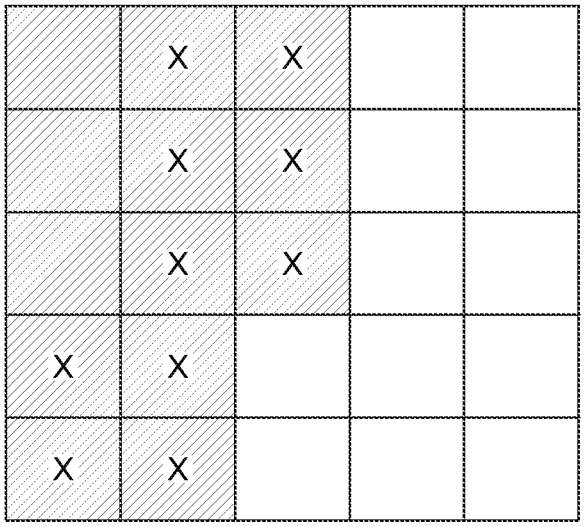
FIG. 18 shows an embodiment similar to FIGS. 11-13 applied in an alternative manner.
Figure 19:
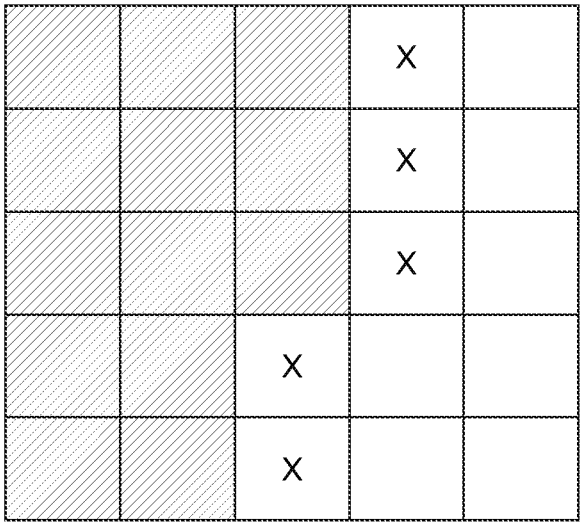
FIG. 19 shows an embodiment similar to FIGS. 11-13 applied in an alternative manner.
Figure 20:
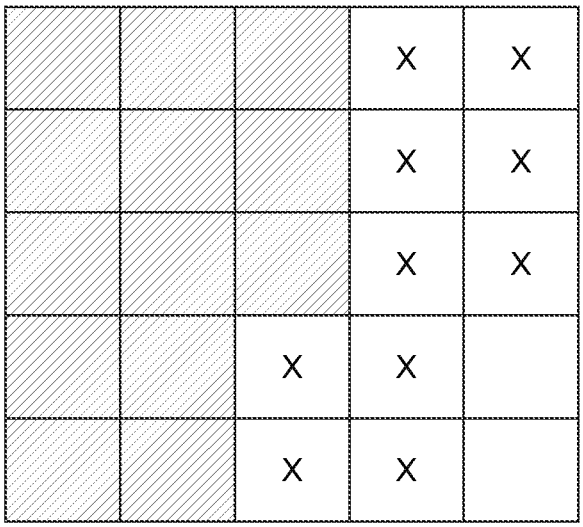
FIG. 20 shows an embodiment similar to FIGS. 11-13 applied in an alternative manner.

FIG. 16 shows blue thin and removal of both colors at the blue/green interface of a single stitch. FIG. 17 shows blue thin yarn and removal of the single stitch (inside) at the blue/green interface. FIG. 18 shows blue thick yarn and removal of two stitches (blue, inside) at the blue/green interface. FIG. 19 shows blue thin yarn and removal outside or one stitch of green at the blue/green interface. Finally, FIG. 20 shows blue thick yarn and removal two stitches from outside (or the green) at the blue/green interface. Other combinations of removal may be performed using the techniques taught herein.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method for automatedly inserting void stitches in the manufacture of pixel mapped patterns on tufting machines having an array of independent yarn feed devices feeding yarns to reciprocating needles comprising the steps of:

(a) creating a multi-color pixel mapped pattern design having a plurality of colors in a bitmap-type file;

(b) loading the bitmap-type file into a computer;

(c) applying an algorithm to identify a last stitch of a particular color when tufting at least two consecutive stitches of a particular color;

(d) automatedly changing the pattern for at least one of the first and last stitch of the particular color by one of: (i) substituting a no-sew location for at least one of the first and last stitch of the particular color, (ii) reducing yarn feed rates at the at least one of first and last stitch of the particular color, and (iii) engaging an LCL to automatedly cut loops of at least one of the first and last stitch of the particular color as an output; and then (e) tufting the output with the tufting machine.

2. The method of claim 1 wherein the change to the pattern for at least one of the first and last stitch of a particular color comprises one of: by one of: (i) substituting a no-sew location for at least one of the first and last stitch of the particular color, (ii) reducing yarn feed rates at the at least one of first and last stitch of the particular color, and (iii) engaging an LCL to automatedly cut loops at least one of the first and last stitch of the particular color.

3. The method of claim 1 wherein a user selects which of a plurality of colors are the particular color for the algorithm to identify.

4. The method of claim 1 wherein all of the plurality of colors are identified by the algorithm and the at least one of the first and last stitches automatedly changed.

5. The method of claim 1 wherein the at least one identified stitch is replaced with at least two no-sew locations.

6. The method of claim 1 wherein a user selects a particular location of the pattern design to apply the algorithm of steps (c) and (d) to at least one of the plurality of colors.

7. The method of claim 1 wherein a user selects a particular yarn assigned to the pattern design to have the algorithm applied in steps (c) and (d).

8. The method of claim 1 wherein a first yarn is assigned multiple colors of the plurality of colors and only some of the multiple colors are affected by the algorithm employed at steps (c) and (d).

9. The method of claim 1 wherein at step (d) multiple adjacent no-sew locations are provided starting at the location of the identified one of the first and last stitch.

10. A method for automatedly inserting void stitches in the manufacture of pixel mapped patterns on tufting machines having an array of independent yarn feed devices feeding yarns to reciprocating needles comprising the steps of:

(a) creating a multi-color pixel mapped pattern design having a plurality of colors in a bitmap-type file;

(b) loading the bitmap-type file into a computer;

(c) applying an algorithm to identify a neighborhood of a prospective stitch location having at least one potential stitch location not laterally adjacent to the prospective stitch of a particular color when tufting at least two consecutive stitches of a particular color;

(d) if the neighborhood meets pre-determined criteria, automatedly changing the pattern for the prospective stitch as an output;

(e) tufting the output with the tufting machine.

11. The method of claim 10 wherein the change to the pattern for at least one of the first and last stitch of a particular color comprises at least one of: by one of: (i) substituting a no-sew location for at least one of the first and last stitch of the particular color, (ii) reducing yarn feed rates at the at least one of first and last stitch of the particular color, and (iii) engaging an LCL to automatedly cut loops at least one of the first and last stitch of the particular color.

12. The method of claim 10 wherein the neighborhood identified in step (c) evaluates potential stitch locations surrounding the prospective stitch location.

13. The method of claim 12 wherein the predetermined criteria evaluate whether the prospective stitch is inside or outside relative to a different stitch characteristic.

14. The method of claim 13 wherein the change to the pattern is inserting at least two no-sew locations in place of the prospective stitch and an adjacent location.

15. The method of claim 14 wherein the user may select at least aspects of the predetermined criteria.

16. A method for automatedly inserting void stitches in the manufacture of pixel mapped patterns on tufting machines having an array of independent yarn feed devices feeding yarns to reciprocating needles comprising the steps of:

(a) creating a multi-color pixel mapped pattern design having a plurality of colors in a bitmap-type file;

(b) loading the bitmap-type file into a computer;

(c) applying an algorithm to identify one of a first and a last stitch as an end stitch of a particular color when tufting at least two consecutive stitches of a particular color relative to a neighborhood of potential stitches, with at least one potential stitch not in contact with the end stitch;

(d) automatedly changing the pattern for the end stitch of the particular color as an output if meeting predetermined criteria;

(e) tufting the output with the tufting machine.

17. The method of claim 16 wherein the change to the pattern for at least one of the first and last stitch of a particular color comprises at least one of: by one of: (i) substituting a no-sew location for at least one of the first and last stitch of the particular color, (ii) reducing yarn feed rates at the at least one of first and last stitch of the particular color, and (iii) engaging an LCL to automatedly cut loops at least one of the first and last stitch of the particular color.

18. The method of claim 16 wherein a user selects which of a plurality of colors are the particular color for the algorithm to identify.

19. The method of claim 16 wherein all of the plurality of colors are identified and evaluated by the algorithm.

20. The method of claim 16 wherein a user selects at least aspects of the predetermined criteria.

* * * * *